US006357186B1

(12) United States Patent
Gould

(10) Patent No.: US 6,357,186 B1
(45) Date of Patent: Mar. 19, 2002

(54) SELF-VENTING WINDOW FRAME

(75) Inventor: Charles H. Gould, North Vancouver (CA)

(73) Assignee: Marzen Artistic Aluminum Ltd., Langley (CA)

( * ) Notice: Subject to any disclaimer, the term of this patent is extended or adjusted under 35 U.S.C. 154(b) by 0 days.

(21) Appl. No.: 09/662,757

(22) Filed: Sep. 15, 2000

(51) Int. Cl.[7] ..... E06B 7/14
(52) U.S. Cl. ..... 52/209
(58) Field of Search ..... 52/209, 302.1, 52/302.3; 49/408, 471, 476.1

(56) References Cited

U.S. PATENT DOCUMENTS 3,314,201 A 4/1967 Riegelman
3,410,027 A 11/1968 Bates
3,503,169 A * 3/1970 Johnson et al. ..... 52/209
3,636,660 A 1/1972 Peterson
3,845,599 A 11/1974 Jolly
3,849,938 A 11/1974 Thompson
3,858,375 A 1/1975 Silvernail
4,003,171 A 1/1977 Mitchell
4,475,324 A 10/1984 Flakk
5,044,121 A 9/1991 Harbom et al.
5,787,659 A * 8/1998 Rinehart ..... 52/209
5,822,934 A 10/1998 O'Donnell
5,887,387 A 3/1999 Dallaire

* cited by examiner

*Primary Examiner*—Carl D. Friedman
*Assistant Examiner*—Steve Varner
(74) *Attorney, Agent, or Firm*—C. A. Rowley

(57) ABSTRACT

A hollow window frame structure is provided with a one way valve to permit flow from the exterior of the building to the interior of the building through the hollow frame when the air pressure is higher outside than in the interior of the building and impair flow from the interior of the building to the exterior of the building when the air pressure in the interior of the building is higher than the exterior pressure.

8 Claims, 3 Drawing Sheets

PRIOR ART

SELF-VENTING WINDOW FRAME

FIELD OF INVENTION

The present invention relates to a self-venting hollow window frame structure have and improved venting system.

BACKGROUND OF THE INVENTION

Providing weep opening to drain water from the interior of hollow frames such as window frames is common practice. Normally, such systems incorporate a one-way valve to permit the escape of water from within the hollow frame while prohibiting the inflow of air from the outside. In these system the inside of the frame is at a pressure corresponding to the pressure on the interior of the building in which the frame is mounted.

Attention is directed to U.S. Pat. No. 3,314,201 issued Apr. 15, 1967; U.S. Pat. No. 3,410,027 issued Nov. 12, 1968; U.S. Pat. No. 3,503,169 issued Mar. 31, 1970; U.S. Pat. No. 3,636,660 issued Jan. 25, 1972; U.S Pat. No. 3,849,938 issued Nov. 26, 1938; U.S. Pat. No. 3,858,357 issued Jan. 7, 1975 to Silvernail; U.S. Pat. No. 5,787,659 issued Aug. 4, 1998; U.S. Pat. No. 5,822,934 issued Oct. 20, 1998 and U.S. Pat. No. 5,887,387 issued Mar. 30, 1999 provide examples of drainage systems for hollow frames that control air flow from the exterior of the building toward the interior of the building, many of which use one way valves for such control. The majority of the patented systems position the one way valve on an outside wall of the frame, U.S. Pat. No. 3,314,201 places the valve in an intermediate wall and employs surface tension to hold the valve closed. U.S. Pat. No. 3,849,938 provides a system of draining the frame of a louvered window also places the flap valve on in intermediate wall.

U.S. Pat. No. 5,044,121 equalizes air pressure on the inside of the frame with that on the exterior of the building to under high wind conditions to avoid drawing up and accumulation of water in the sash by providing vent holes communicating with the outside at the top of the sash connecting the interior of the sash with the outside pressure and drain holes at the bottom of the sash also communicating with the outside so that the internal pressure around the frame is the same as the outside pressure.

U.S. Pat. No. 3,845,599 issued Nov. 5, 1974 uses the level of water to be drained to open and close a valve leading from the hollow interior of the frame to the building interior side of the frame. The valve only closes if the level in which the float valve is contained increases to a certain level, however a hydraulic seal is maintained at all times between the outside of the building and the inside U.S. Pat. No. 4,003,171 issued Jan. 18, 1997 also uses water in the hollow frame to open a valve to permit water to drain to the outside.

U.S. Pat. No. 4,475,324 issued Oct. 9, 1984 discloses a specific valve for a vent opening through a window frame or the like and connecting the interior of the building with the exterior.

BRIEF DESCRIPTION OF THE PRESENT INVENTION

It is an object of the invention to provide an improved venting and draining system for hollow window frame or the like structures.

Broadly the present invention relates to a frame structure incorporating an improved venting system said window frame structure including a plurality hollow frame pieces forming inside passages in said frame structure, drain holes interconnecting said inside passages to form a drain passage leading through said inside passages to a drain hole through said fame connecting said inside passage to outside of said frame, the improvement comprising a one way valve mounted in an inner wall of said frame in a position to interconnect said inside passage with the interior of a building in which said window frame is mounted and oriented to impair flow into said building from said inside passage when air pressure in said inside passage is higher than air pressure in said interior of said building and to permit flow from said interior of said building to said inside passage when air pressure in said interior is higher than air pressure in said inside passage.

Preferably said valve is a flapper type valve.

Preferably said valve is constructed to be slightly open when air pressures on opposites sides of said valve are essentially the same.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

DETAILED DESCRIPTION OF THE INVENTION

The following description will be directed to window frames, but the invention may be applied to other similar frame structures.

Figure 1:
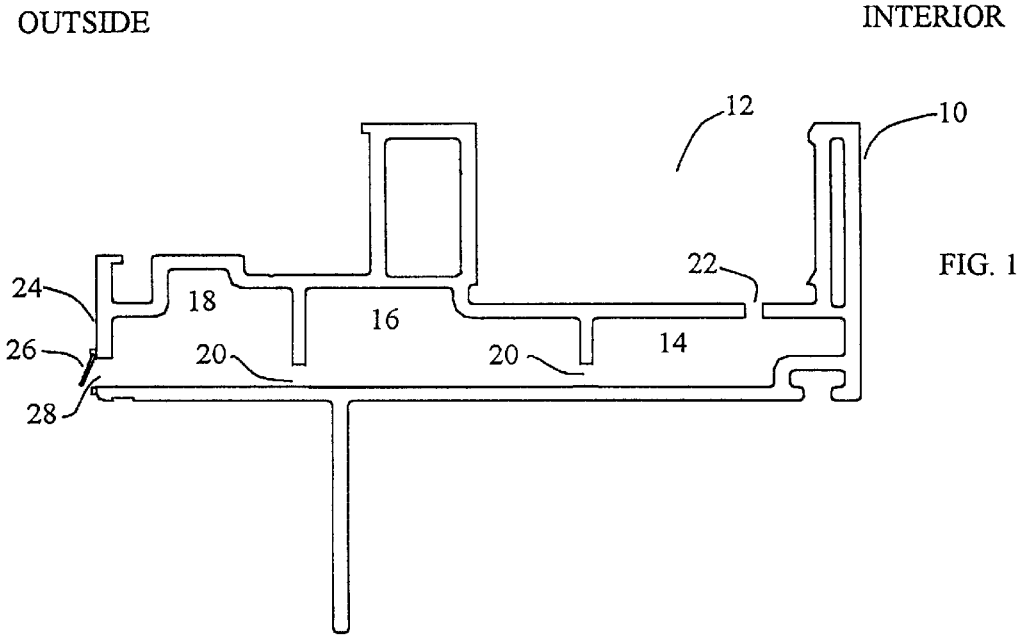
FIG. 1 is an illustration of the Prior Art showing a conventional venting system that seals the venting passages to prevent outflow of air from the building interior while permitting inflow of air from the building exterior.

Before describing the invention attention is directed to FIG. 1, which shows a typical frame construction composed of a frame 10 with an internal slider track 12 communicating with the interior of the building. The frame 10 is hollow and is formed with compartments such as those indicated at 14, 16 and 18 that are interconnected by drain holes 20 to permit draining of water to the outside. A suitable drain hole schematically indicated at 22 permits condensate to drain from the slider track 12 into one of the compartments (14 in the illustrated version) and be drained from the inside of the frame 10. A one way valve 24 usually some form of flap valve is positioned in the system in the illustrated arrangement on the outside wall 26 so that the opening 28 therethrough is open to permit drainage while preventing inflow of air from the outside when the pressure outside is higher than the pressure inside the frame 10 i.e. pressure in the compartments 14, 16 and 18 in the illustrated arrangement which is the same as the interior of the building is lower than that outside. With this arrangement the flap valve 24 is in closed position when the interior (inside the building) pressure is lower than the outside pressure.

Figure 2:
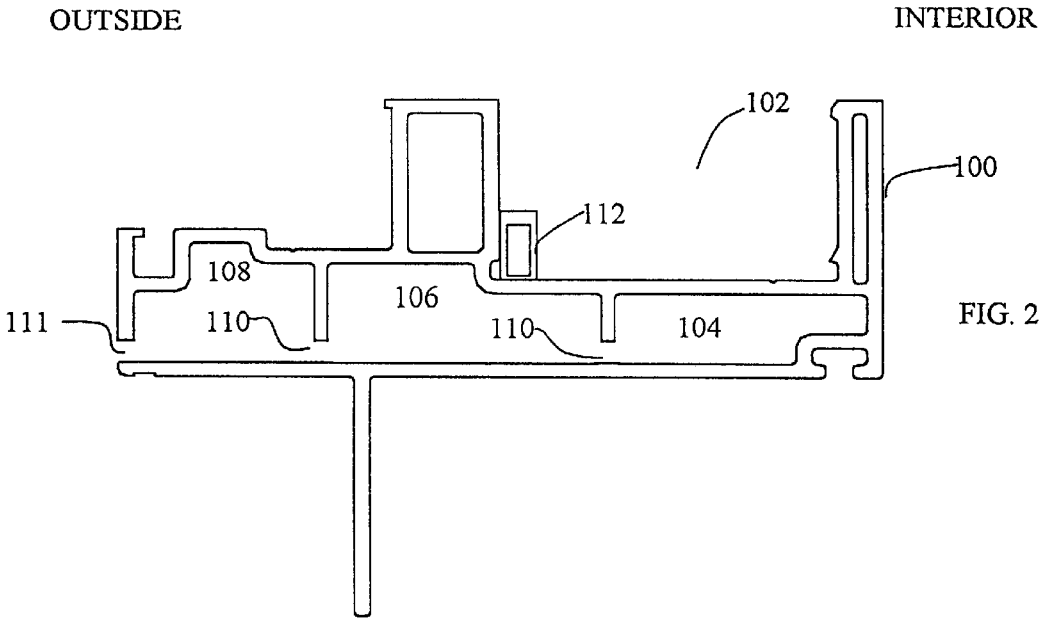
FIG. 2 is an illustration of the present invention system that seals the venting passages to permit outflow of air from the building interior while preventing inflow of air from the building exterior.

FIG. 2 schematically illustrated the present invention incorporated into a hollow frame 100 with a slider track 102 open to the interior of the building and inside compartments 104, 106 and 108 interconnected by drain openings 110 (similar to the frame 10) and vented to the outside by a drain hole 111. The invention replaces the drain hole 22 of the prior art with a one way valve 112 (to be described below) with a through passage 114 (see FIGS. 3 to 8) and that is closeable in the illustrated arrangement by a flap 116. The valve 112 permits the outflow of air (and water) from the interior of the building when the pressure in the building is higher than the outside pressure and prevents the flow of air into the building when the pressure outside is higher than the pressure in the interior of the building. Positioning the valve 112 on an inner wall (e.g. wall 118 see FIG. 3) of the frame 100 (inner wall means a wall directly exposed to the interior of the building and not exposed to the outside, but as an alternative may include other walls sufficiently spaced from the outside of the frame so that the valve is completely shielded form direct exposure to the outside conditions rain, wind, etc. outside of the building). The inner wall and has the interior pressure of the building on one side and the outside pressure (pressure inside the hollow frame 100 which with the present invention—is equal to the outside pressure) on the other. Thus the flap 116 is positioned at a location in the hollow frame 100 where it is shielded from the direct action of the outside conditions. Positioning the valve on such an inner wall ensures that that the pressure drop across the valve flap 116 does not tend to suck moisture into the inside of the frame 100 as occurs with the position of the valve flap 24 on or immediately adjacent to an exposed outer (outside) wall of the frame, is an important feature of the invention. Orienting the valve to open when the pressure on the interior of the building exceeds that of the inside of the hollow frame 100 is another important feature of the present invention.

Constructing the frame as described the present invention allows the inner chambers e.g. 104, 106 and 108 to be at the same pressure as the outside so that when water runs down the outer face of the window there is no pressure drop across a valve on the outer face that would tend to draw water into the chambers. With the present invention the pressure differential (drop) is between the interior of the building and the inside chambers (e.g. 104, 106 and 108) of the frame 100. This arrangement also premits water that gets into the inside of the frame 100 to drain freely to the outside and from being aspirated into the slider track 102.

Thus with the present invention the one way valve 112 seals off the slide track from movement of water and/or air in either direction through the valve 112 when the pressure in the interior is lower than the outside pressure, (i.e. when air flow tends to inward from the outside to the interior of the building i.e. when the outside pressure (in the inside of the frame 100) is higher than the pressure in the interior of the building) and allows the compartments such as 104, 106 and 108 to be at the same pressure as the outside pressure and therefore drain easier without allowing back flow of air into the slider track 102. This in effect permits the hollow frame to function in a manner similar to a rain screen wall.

Figure 3:
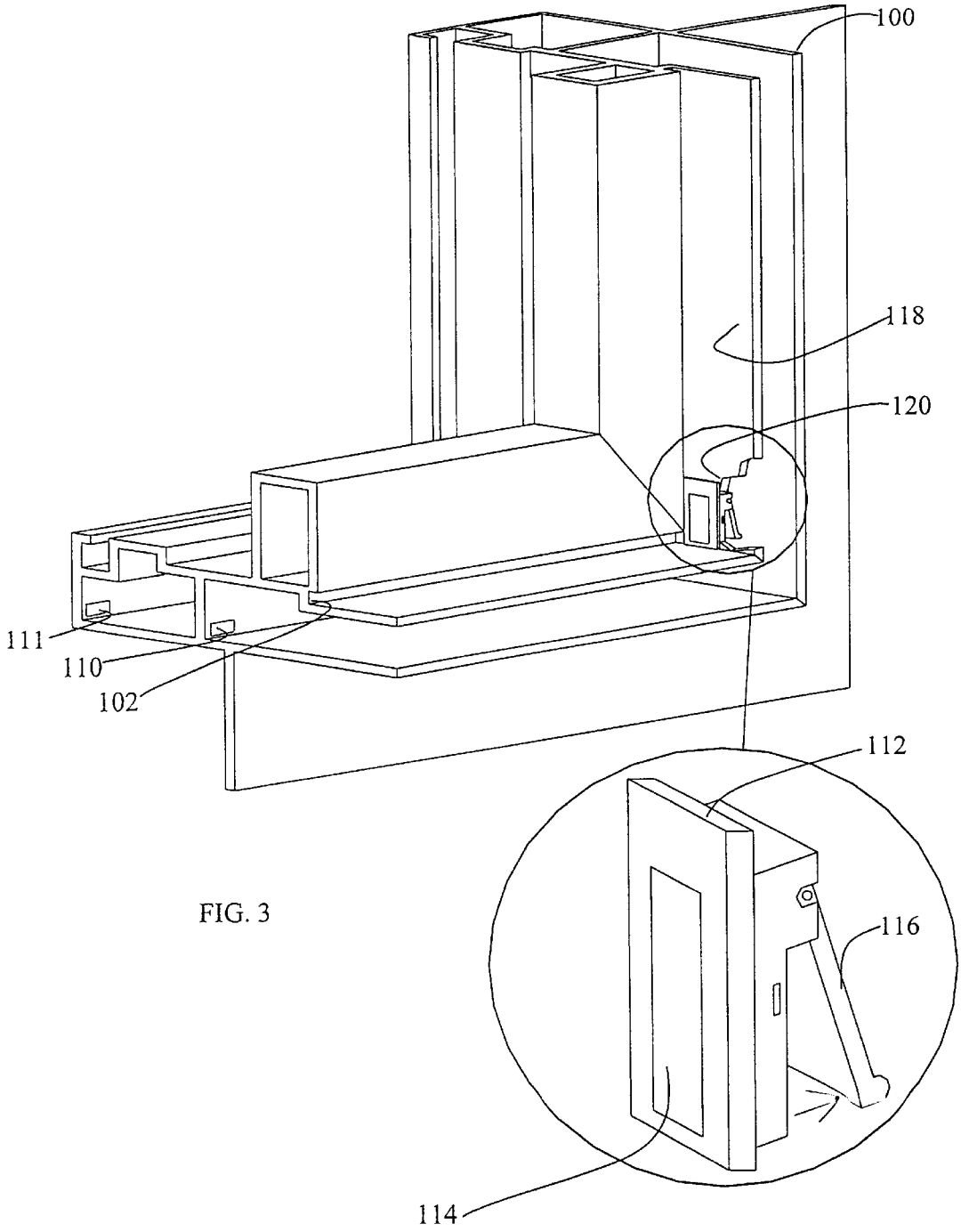
FIG. 3 is an exploded view showing how the valve is to be positioned in the frame and a preferred location for the valve in the frame structure.
Figure 4:
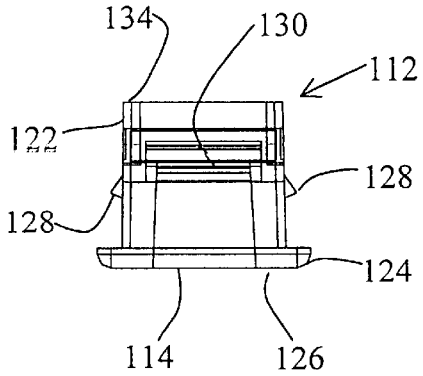
FIG. 4 is a plan view of a preferred form of one-way (self closing) flap valve for use in the present invention.
Figure 5:
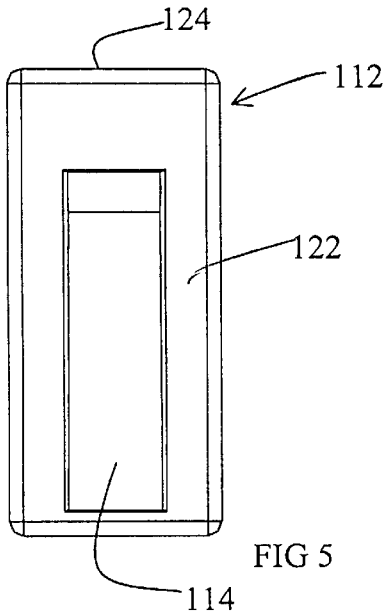
FIG. 5 is a front view of the valve of FIG. 4.
Figure 6:
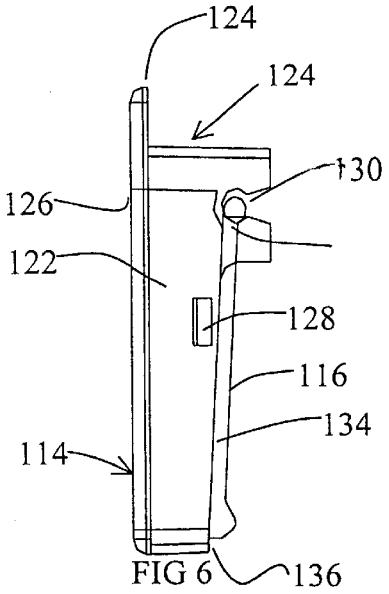
FIG. 6 is a side view of the valve of FIG. 4.
Figure 7:
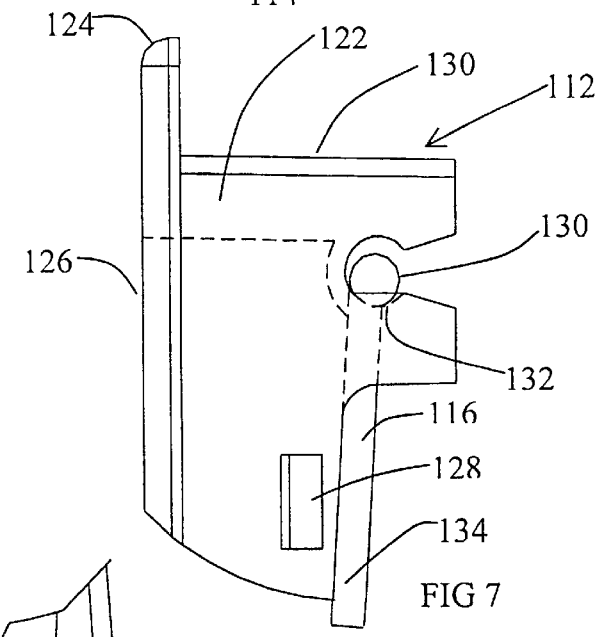
FIG. 7 is an enlarged partial side view of the hinge mounting for the closing flap of the valve of FIG. 4.
Figure 8:
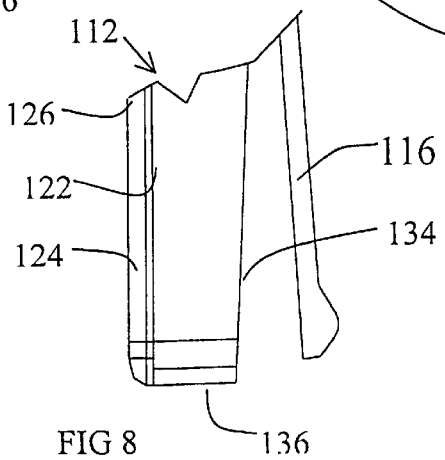
FIG. 8 is an enlarged partial side view of the valve of FIG. 4 showing the flap in neutral position when the interior and exterior pressures are essentially the same.

Turning now to FIG. 3 the valve 112 as shown by the exploded view is forced into a suitable opening 120 through the inner wall 118 and in effect is snapped into position within the hole or opening 120. It must be emphasized that the valve 112 is positioned so that it opens when the pressure in the track 102 (building interior) is higher than the pressure in the inside of the frame 100 i.e. with the flapper on the side of the valve 112 facing the inside of the frame 100.

In the preferred arrangement a flapper valve such as that shown in more detail in FIGS. 4 to 8 inclusive is used. This valve 112 is a flapper type valve formed with a peripheral housing 122 having a through passage 114. A circumferential flange 124 extends around the housing 122 on the inner face 126 (face opening to the interior of the building). Suitable ribs such as those shown at 128 on the sides of the housing 122 and 130 at the top of the housing are spaced from the flange 124 by the thickness of the inner frame wall 118 and the hole 120 is sized so that the ribs are deformed as the valve is forced into the hole 120 and snap into relaxed position to clamp the wall 118 between the ribs and the flange 124 and thereby hold the valve 112 in position.

The flapper 116 is formed with a pair of hinge pins 130 (only one shown) each of which is received in its bearing socket or seat 132 formed in the housing 122 adjacent to the top end of the valve 112. The rear face 134 of the housing 122 is sloped so that the top end where the hinge seat 132 is formed is farther from the flange 126 than bottom end 136 of the housing 122 so that when the valve is in position (inside of the flange 126 substantially vertical) the flap 116 normal or rest position with essential the same pressure on opposite sides of the flap a drain opening is formed as indicated at 138 at the bottom of the valve 112.

It is not essential that the valve 112 be constructed as described or be biased open when the interior and outside air pressures are essentially the same.

Having described the invention, modifications will be evident to those skilled in the art without departing from the scope of the invention as defined in the appended claims.

I claim:

1. A frame structure incorporating an improved venting system said window frame structure including a plurality hollow frame pieces forming inside passages in said frame structure, drain holes interconnecting said inside passages to form a drain passage leading through said inside passages to a drain hole through said fame connecting said inside passages to outside of said frame, the improvement comprising a one way valve mounted on an inner wall of said frame in a position to interconnect said inside passage with the interior of a building in which said window frame is mounted said valve being oriented to impair flow into said building from said inside passage when air pressure in said inside passage is higher than air pressure in said interior of said building and to permit flow from said interior of said building to said inside passage when air pressure in said interior is equal to or higher than air pressure in said inside passage.

2. A frame as defined in claim 1 wherein said inner wall has one surface directly exposed to said interior of said building.

3. A frame structure as defined in claim 1 wherein said valve is a flapper type valve.

4. A frame structure as defined in claim 2 wherein said valve is a flapper type valve.

5. A frame structure as defined in claim 1 wherein said valve is constructed to be slightly open when air pressure on opposites sides of said valve are essentially the same.

6. A frame structure as defined in claim 2 wherein said valve is constructed to be slightly open when air pressure on opposites sides of said valve are essentially the same.

7. A frame structure as defined in claim 3 wherein said valve is constructed to be slightly open when air pressure on opposites sides of said valve are essentially the same.

8. A frame structure as defined in claim 4 wherein said valve is constructed to be slightly open when air pressure on opposites sides of said valve are essentially the same.

* * * * *